US005446337A

United States Patent [19]

Yokomakura et al.

[11] Patent Number: 5,446,337

[45] Date of Patent: Aug. 29, 1995

[54] IMAGE DISPLAY APPARATUS AND METHOD OF MAKING THE SAME

[75] Inventors: Mitsunori Yokomakura, Takatsuki; Kyouichi Uematsu, Nagaokakyou; Kanji Imai, Takatsuki; Tomohiro Sekiguchi, Kobe; Toshifumi Nakatani, Moriguchi, all of Japan

[73] Assignee: Matsushita Electric Industrial Co., Ltd., Osaka, Japan

[21] Appl. No.: 266,217

[22] Filed: Jun. 27, 1994

[30] Foreign Application Priority Data

Jul. 28, 1993 [JP] Japan ..... 5-186009
Jul. 28, 1993 [JP] Japan ..... 5-186050

[51] Int. Cl.[6] ..... H01J 29/70

[52] U.S. Cl. ..... 313/422; 313/456; 313/495

[58] Field of Search ..... 313/422, 426, 427, 495, 313/496, 456

[56] References Cited

U.S. PATENT DOCUMENTS 4,955,681 9/1990 Sekihara et al. ..... 313/422 X
5,003,219 3/1991 Muragishi et al. ..... 313/456
5,189,335 2/1993 Sekihara et al. ..... 313/422

FOREIGN PATENT DOCUMENTS

050295A1 4/1982 European Pat. Off. .
0316871 5/1989 European Pat. Off. .
60-70638 4/1985 Japan .
1-130453 5/1989 Japan .
JP2061948 3/1990 Japan .

*Primary Examiner*—Sandra L. O'Shea
*Assistant Examiner*—Ashok Patel
*Attorney, Agent, or Firm*—Ratner & Prestia

[57] ABSTRACT

An image display apparatus includes an electron beam generating source for generating the electrons which travel in parallel with each other and an extraction electrode for extracting the electron beams from the generated electrons. A control electrode is also included for selectively controlling a second quantity of electrons in the electron beams which have passed through the extraction electrode and a horizontal deflection electrode for electrostatically deflecting the electron beams. A vertical deflection electrode is provided for deflecting the electron beams which have passed through the horizontal deflection electrode. The vertical deflection electrode has a first comb-shaped conductive sheet having first parallel members and a second comb-shaped conductive sheet having second parallel members. The first members and the second members are alternatively formed adjacent to each in the horizontal direction. Furthermore, the first comb-shaped conductive sheet and the second comb-shaped conductive sheet have notches formed at regular intervals. The horizontal deflection electrode and the vertical deflection electrode are insulated from each other.

6 Claims, 8 Drawing Sheets

FIG.9(a)
PRIOR ART
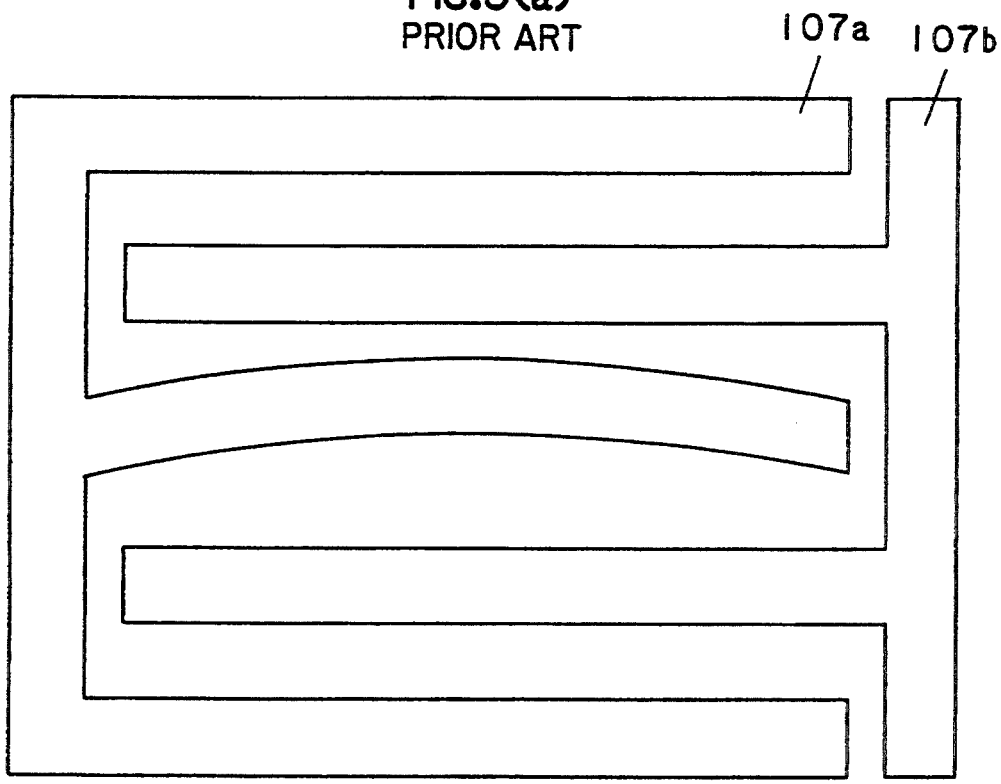
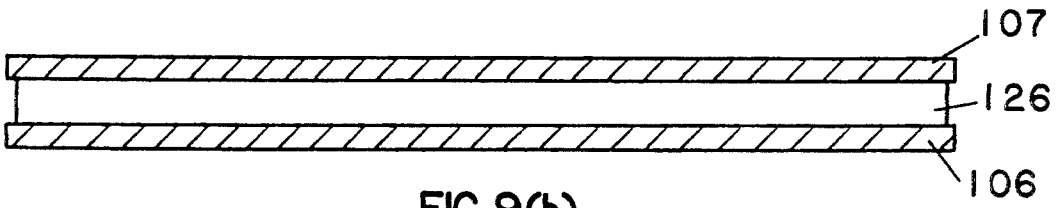
FIG.9(b)
PRIOR ART

IMAGE DISPLAY APPARATUS AND METHOD OF MAKING THE SAME

BACKGROUND OF THE INVENTION

The present invention relates to an image display apparatus to be employed in a television set or a computer peripheral display and a method of making the same.

Cathode ray tubes have been mainly used as the image display apparatus for color television sets. Since cathode ray tubes have a large depth as compared to the size of the screen, it has been difficult to make a flat type television set.

EL (electro-luminescent) devices, plasma displays and liquid crystal display devices have been used for flat type image display devices. However, these devices have not provided satisfactory performance for luminance, contrast, and color reproducibility.

A conventional flat type screen device is shown in FIG. 7. The conventional device includes an image which is to be projected onto a fluorescent screen and which is first divided into vertical sections vertically having a number of lines. Each image is also divided into horizontal subsections. The horizontal and vertical subsections are arranged in a matrix so that when the image is displayed there is not a gap between subsections.

Electron beams are deflected and scanned on the screen within each subsection. The electron beams cause red fluorescent material, green fluorescent material, and blue fluorescent material on the screen to emit colored light. A color image signal controls the amount of electrons with the electron beam to produce the image. The emitted color light from each subsection forms the entire image on the fluorescent screen. The construction of the conventional image display apparatus is explained below.

FIG. 7 is an internal perspective view of a conventional image display apparatus. The image display apparatus includes a rear electrode 101, a linear cathode 102*a*, 102*b* and 102*c* which are used to generate electrons, extraction electrode 103, focusing electrode 105, horizontal deflection electrode 106, and vertical deflection electrodes 107*a* and 107*b*.

These components are disposed in a front container 108 and rear container 109 which hold the components in a vacuum.

Rear electrode 101 is a flat conductive sheet disposed in parallel with the linear cathodes 102*a*, 102*b*, and 102*c*. Linear cathodes 102*a*, 102*b*, and 102*c* are parallel to each other and formed in the vertical direction from top to bottom. Each linear cathode 102*a*, 102*b*, and 102*c* extends along the horizontal (Y axis) direction to produce an electron flow having a nearly uniform current-density-distribution in the horizontal (X axis) direction traveling from the back of the display to the front of the display. Although three linear cathodes 102*a*, 102*b*, 102*c* are shown in the figure, there may be more linear cathodes. Linear cathodes 102*a*, 102*b*, and 102*c* are made of a tungsten wire coated with an oxide.

Extraction electrode 103 is a conductive sheet 111 formed substantially parallel to rear electrode 101 having linear cathodes 102*a*, 102*b*, and 102*c* disposed between the extraction electrode and the rear electrode. Holes 110 are formed in extraction electrode 103 and aligned in the horizontal (Y axis) direction at regular intervals to correspond to each linear cathode 102*a*, 102*b*, 102*c*.

Electrons are generated by linear cathodes 102*a*, 102*b*, and 102*c* and formed into a predetermined number of separate electron beams by passing through holes 110 in extraction electrode 103. Although holes 110 are shown as circular, other shapes for holes 110, such as ellipse, rectangular, or slit-shaped, may be used.

Signal electrode 104 is formed of oblong strips 112. Oblong strips 110 extend from the bottom to the top of the apparatus in the vertical (Z axis) direction and are aligned in the horizontal (Y axis) direction at predetermined intervals. Holes 113 are formed in each of the strips 112 along the Z axis at locations corresponding to holes 110 in extraction electrode 113. In response to an image signal provided to signal electrode 104, signal electrode 104 controls the electron beam's passing through holes 113. Holes 113 may be shaped differently such as an ellipse, rectangular, or slit.

Focusing electrode 105 is a conductive sheet 115 having apertures 114. The holes 114 correspond to strips 112 of signal electrode 104 in the Z axis direction. Focusing electrode 105 controls the intensity of the electron beam. Holes 114 may be shaped as an ellipse, rectangular, or slit.

Horizontal deflection electrode 106 is formed of pairs of conductive strips. Each pair includes strips 116*a* and 116*b* which extend along the vertical (Z axis) direction in parallel to each other. The strips 116*a* and 116*b* are formed on either side of holes 114 of focusing electrode 105.

Vertical deflection electrode 107 has a pair of comb-shaped conductive sheets 107*a* and 107*b* which are interdigitated with each other in the horizontal direction along the same plane.

A fluorescent material layer which emits light when irradiated by an electron beam is coated over an inner surface of the front container 108 forming screen 119. A metal-back layer (not shown) is attached to screen 119.

Extraction electrode 103, signal electrode 104, focusing electrode 105, horizontal deflection electrode 106 and vertical deflection electrode 107 form electrode unit 122. Each electrode is joined by an insulating binder (not shown). Electron beam 117 emitted from line cathode 102 passes through holes 110, 113, and 114 of extraction electrode 103, signal electrode 104, and focusing electrode 105 respectively, and through horizontal deflection electrode 106 and vertical deflection electrode 107 prior to reaching screen 119.

Each electrode of the conventional apparatus must be manufactured and assembled with high accuracy to obtain an uniform image without borders on the fluorescent screen.

In operation, line cathodes 102 are heated by a heater current so that electrons are easily emitted. While the line cathodes 102 are heated, a voltage is applied to rear electrode 101, line cathode 102, and extraction electrode 103.

Line cathodes 102 emit a sheet shaped electron beam. Holes 111 of extraction electrode 103 divide the sheet shaped electron beam into separate electron beams. Then, the electron beams arrive at holes 113 of signal electrode 104. Signal electrode 104 controls the amount of electrons in each electron beam which passes through holes 113 in response to a video signal which is provided to signal electrode 104.

After passing through signal electrode 104, the electron beams are focused at the focusing electrode 105.

The electron beams are focused and shaped by an electrostatic-lens-effect caused by apertures 114. The electron beams are deflected horizontally and vertically by providing a potential difference between the adjacent conductive sheets 116*a* and 116*b* of horizontal deflection electrode 106, and holes 118*a* and 118*b* of vertical deflection electrode 107.

Finally, the electron beams are accelerated to a high energy level by a high voltage which is applied to the metal-back layer of screen 119. The high energy electron beams collide with the metal-back layer causing light to be emitted from the fluorescent material layer.

The screen is horizontally and vertically divided into a matrix arrangement including subsections 120 and 121. Each subsection 120 and 121 is scanned by deflecting one electron beam corresponding to the separated electron beams separated using extraction electrode 103. Accordingly, an entire image is displayed on the screen including red, green and blue video signals which correspond to respective picture elements. The picture elements are continuously controlled by the voltage applied to signal electrode 104.

However, to achieve a quality image, it is required that the electrodes be produced with great position and positioned with high accuracy to obtain a picture with good uniformity without any noticeable border lines between subsections 120 and 121 on screen 119.

As shown in FIG. 8, vertical electrode 107 includes two conductive sheets 107*a* and 107*b*. The two conductive sheets 107*a* and 107*b* are joined. The conductive sheets 107*a* and 107*b* are also joined to horizontal deflection electrode 106 by insulating binder 126 shown in FIG. 9B.

Horizontal deflection electrode 106 and vertical deflection electrode 107 are joined in a high temperature electric furnace. Horizontal deflection electrode 107 is very thin and narrow having a depth of 0.2 mm and a width of 3.6 mm. As the image display apparatus is enlarged, the length of the electrode plates become large. For example, a diagonal six-inch image display apparatus has corresponding conductive sheets of 130 mm in length. Because of the increased length, when conductive sheets 107*a*, 107*b* and horizontal deflection electrode 106 are joined in the high temperature electric furnace, deformation in conductive sheets 107*a* and 107*b* may result as shown in FIG. 9A. The deformation causes an unsuitable deflection of the electron beam. This results because the deflection is determined by the potential difference between conductive sheets 107*a* and 107*b*. If the conductive sheets are deformed, an uniform picture will not be produced. In addition, conductive sheets 107*a* and 107*b* may not be positioned along the same plane which causes a difference in the level between conductive sheets 107*a* and 107*b*.

The improper deflection of the electron beams 123 and 124 as a result of the defective vertical electrode 107 is shown in FIG. 10. The difference in level between conductive sheets 107*a* and 107*b* causes the electron beams to imprecisely strike a subsection of screen 119. Fluctuation in the electron beams striking each subsection on screen 119 prevents a highly uniform picture from being produced.

As is evident from the forgoing, a flat type image display apparatus which has a high quality image and avoids the above problems is needed.

SUMMARY OF THE INVENTION

The present invention relates to an image display apparatus including a rear electrode which controls the amount electrons in an electron beam. Further included is an electron generating source which emits electrons. An extraction electrode extracts electron beams from the emitted electrons from the linear cathode. Each electron beam travels along a constant direction. A control electrode is further provided for selectively controlling the amount of electrons in the electron beams from the extraction electrode. Further included is a horizontal deflection electrode for electrostatically deflects the electron beams which have passed through the focusing electrode A vertical deflection electrode having a pair of comb-shaped conductive sheets which are interdigitated with each other in a horizontal direction along the same plane is also provided. The vertical deflection electrode also includes notches positioned along the comb-shaped conductive sheets at regular intervals. The horizontal deflection electrode and the vertical deflection electrode are insulated from each other. Further included is a display means for emitting light corresponding to the electron beams which have passed through the vertical deflection electrode.

Furthermore, for example, the electron beam generating source may be linear cathodes. In addition, the conductive sheets may be insulated by low melting point solder glass.

The present invention further relates to an image display apparatus that includes a rear electrode which controls the amount of electrons contained in an electron beam. Also provided are linear cathodes which are formed in parallel with each other to emit electrons and an extraction electrode extracts electron beams along a specified direction from the emitted electrons from linear cathode. Also included is a control electrode for selectively controlling the amount of electrons in the electron beams which pass through the extraction electrode. A focusing electrode electrostatically focuses the electron beams after passing through the control electrode and a horizontal deflection electrode electrostatically deflects the electron beams which have passed through the focusing electrode. Further provided is a vertical deflection electrode having a pair of comb-shaped conductive sheets which are interdigitated with each other in a horizontal direction along the same plane. Also included is a display device which emits light corresponding to the electrons from the electron beams which have passed through the vertical deflection electrode. Each conductive sheet of the vertical deflection electrode further includes projection sections and notches which are formed on either side of the projection parts.

The present invention further relates to insulating the conductive sheets using low melting point solder glass.

The present invention also relates to a method for making a vertical deflection electrode for an image display apparatus. The method includes the steps of forming conductive sheets into intermittently connected first and second conductive sheets connected by a connecting part, and bonding the vertical deflection electrode to another electrode using an insulating material. The method further includes the steps of removing insulating material and the connecting part to produce a vertical deflection electrode having a pair of comb-shaped conductive sheets which are interdigitated with each other and which have notches formed at regular intervals. The vertical deflection electrode and the other electrode are insulated from each other.

Alternatively, the conductive sheet may be formed into intermittently connected first and second conductive sheets by etching. Further, the insulating material may be low melting point solder glass.

The present invention further relates to another method for making a vertical deflection electrode for an image display apparatus. The method includes the steps of forming the conductive sheet having intermittently connected first and second conductive sheets connected by a connecting part, which has a center section and two ends. The center section has a hole and is wider than both ends section which connect the first and second conductive sheets. The method also includes bonding the vertical deflection electrode to another electrode with insulating material.

The method further includes the steps of identifying a portion of the connecting part to be removed using the hole, removing the connecting part to produce the vertical deflection electrode having a pair of comb-shaped conductive sheets which are interdigitated with each other, and which have projection parts with notches formed either side.

Alternatively, the conductive sheet is formed into the intermittently connected first conductive sheet and second conductive sheet by etching. In addition, the insulating material may be low melting point solder glass.

BRIEF DESCRIPTION OF THE DRAWINGS

FIGS. 9*a* and 9*b* show a plane view and a cross sectional view of the conventional image display apparatus.

DETAILED DESCRIPTION OF PREFERRED EMBODIMENT

Figure 7:
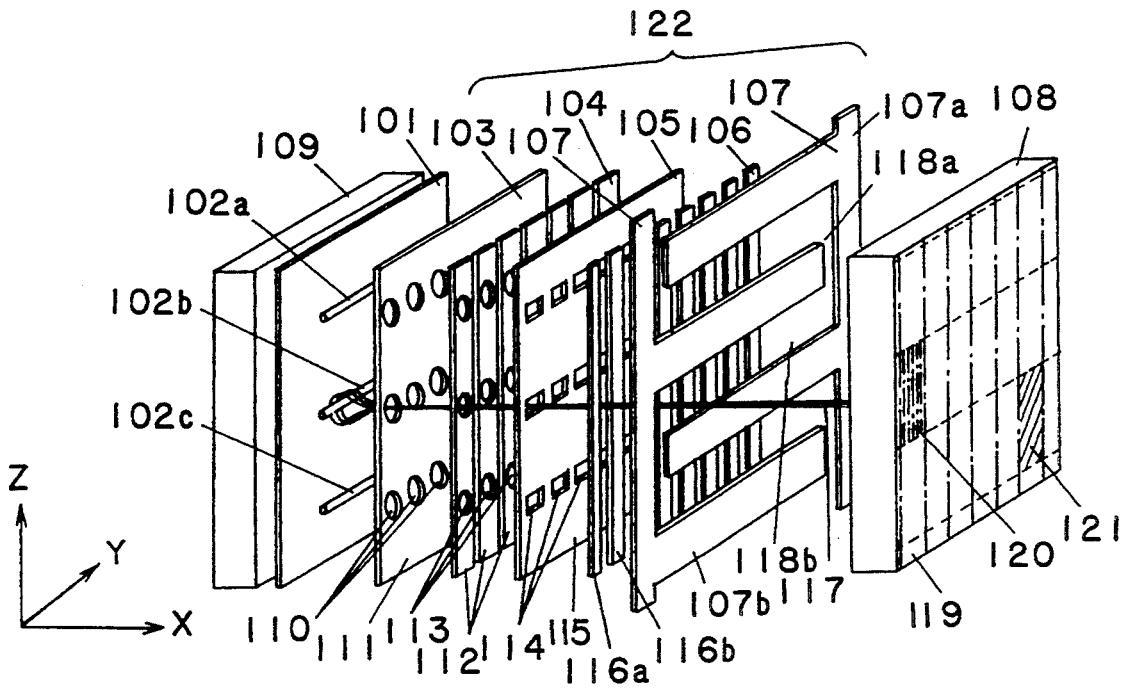
FIG.7 PRIOR ART
FIG. 7 shows an internal perspective view of a conventional image display apparatus.
Figure 8:
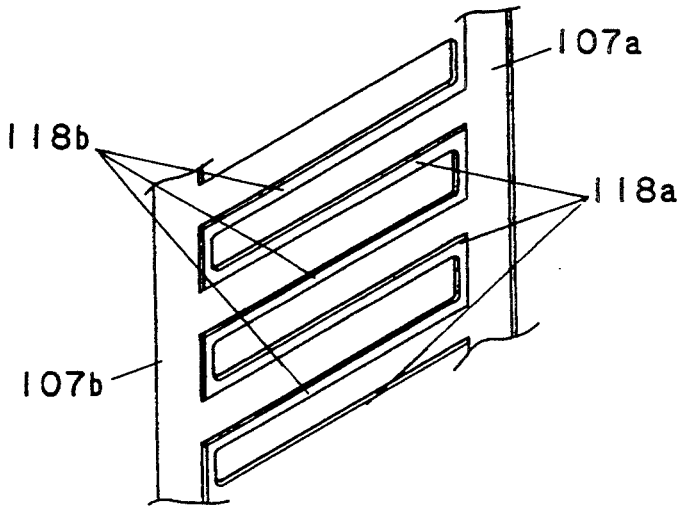
FIG.8 PRIOR ART
FIG. 8 shows a perspective view of the vertical deflection electrode of the conventional image display apparatus.
Figure 10:
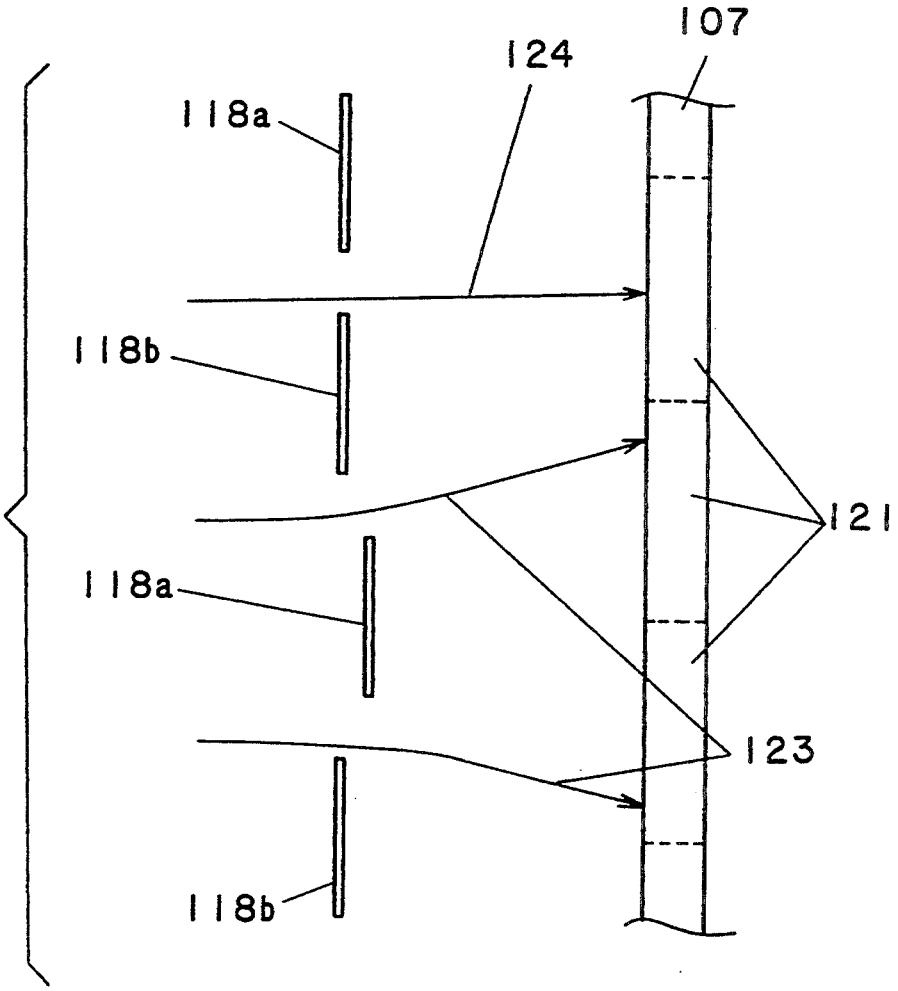
FIG. 10 PRIOR ART
FIG. 10 shows a partial cross sectional view of the conventional image display apparatus.

As shown in FIG. 7, rear electrode 101, linear cathode 102*a*, 102*b*, and 102*c*, extraction electrode 103, signal electrode 104, focusing electrode 105, horizontal deflection electrode 106, and vertical deflection electrode 107 are disposed in a case including a front container 108 having a coated fluorescent material and a rear container 109. Extraction electrode 103, signal electrode 104, horizontal deflection electrode 106, and vertical deflection electrode 107 are integrated as electrode unit 122. The case includes front container 108 and rear container 109 which holds electrode unit 122 in a vacuum. Each of the components are disposed in the image display apparatus in a similar manner as the components in the conventional image display apparatus.

The electrodes are united into an electrode unit 122. Low melting point solder glass with a low melting point is used for binding the electrodes together. The low melting point solder glass has a cylindrical shape which is several centimeters long and 0.4 μm diameter thick. The electrodes are bonded together by putting the solder glass between the electrodes. The solder glass is located so that it does not interfere with the path of the electron beams. After the solder glass is placed between two electrodes, it is heated causing the solder glass to melt and fuse the electrodes together to form electrode unit 122. The solder glass also provides spacing and insulation between the electrodes.

EXAMPLE 1

The construction of the vertical electrode is explained below.

First, a thin conductive sheet, 0.8 mm, is etched into an intermittently connected first conductive sheet and second conductive sheet which are connected by a connecting part.

Figure 1:
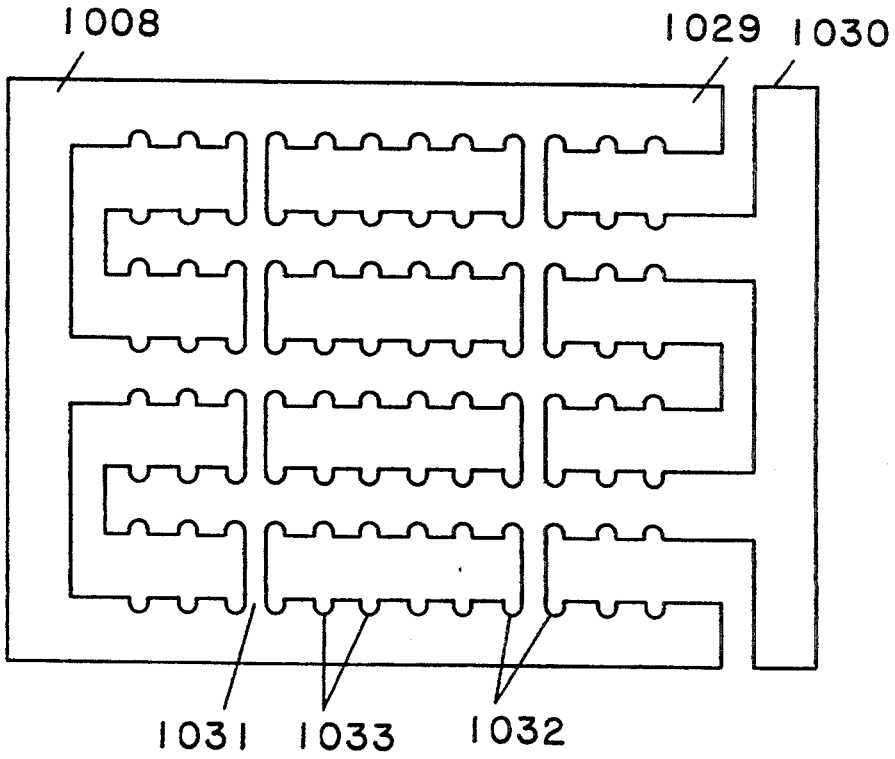
FIG. 1 shows a plane view of the vertical deflection electrode according to an exemplary embodiment of the present invention.

FIG. 1 is a plane view of vertical deflection electrode 1008 of the image display apparatus according to an exemplary embodiment of the invention after etching. Vertical deflection electrode 1008 includes first and second conducting sheets 1029 and 1030, respectively. Connecting part 1031 connects first conductive sheet 1029 and second conductive sheet 1030. Notches 1032 are formed by etching on either side of connecting part 1031. Furthermore, notches 1033 are formed on conducting plates 1029 and 1030 at regular intervals.

Figure 2:
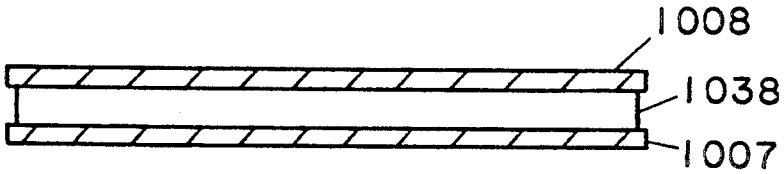
FIG. 2 shows a cross sectional view of the vertical and horizontal deflection electrodes according to an exemplary embodiment of the present invention.
Figure 3:
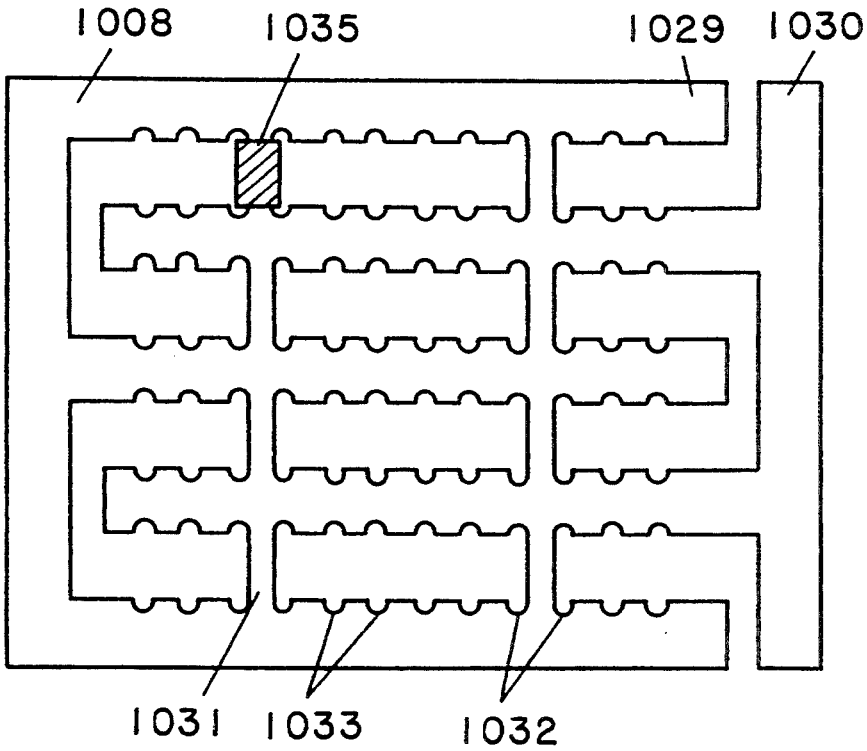
FIG. 3 shows a plane view of the vertical deflection electrode according to an exemplary embodiment of the present invention.

Insulating material such as solder glass 1038 bonds vertical deflection electrode 1008 and horizontal electrode 1007 after heating in a high temperature electric furnace (not shown) as shown in FIG. 2. After or at the same time vertical and horizontal deflection electrodes 1008 and 1007 are bound together, connecting parts 1031 are cut by a cutting machine. The hatched section 1035 in FIG. 3 shows the removed connecting part. Vertical and horizontal electrodes 1008 and 1007 are not separated.

Connecting parts 1031 prevent deformation of conductive sheets 1029 and 1030 when vertical deflection electrode 1008 and horizontal deflection electrode 1007 are bound together by the solder glass in the electrical furnace. As a result, an accurate configuration for the vertical deflection electrode is maintained.

Notches 1032 formed on both sides of connecting parts 1031 prevent conductive sheets 1029 and 1030 from being cut when severing connecting part 1031. When severing connecting part 1031, conductive sheets 1029 and 1030 suffer shearing stress. Notches 1032 dispose this shearing stress.

This makes disconnecting connecting part 1031 easy and accurate.

Figure 4A:
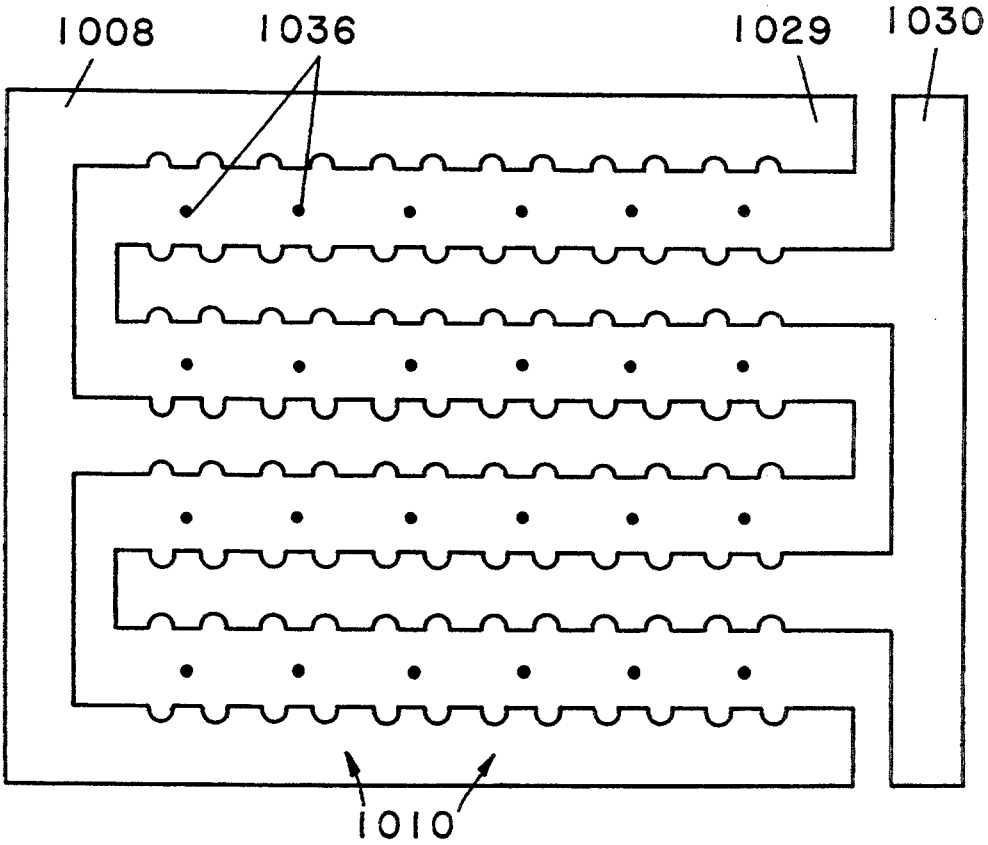
FIGS. 4*a* and 4*b* show a plane view and cross sectional view respectively of a completed vertical deflection electrode according to an exemplary embodiment of the present invention.
Figure 4B:
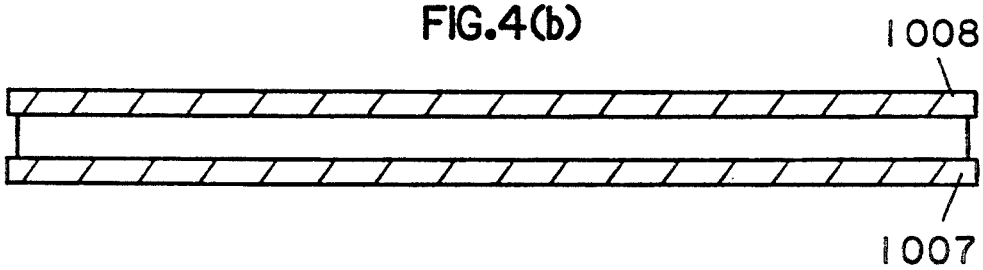

FIG. 4(*a*) is a plan view of the completed vertical deflection electrode, formed from first and second conductive sheets 1029 and 1030 where all connecting parts 1031 have been removed. The completed vertical deflection electrode 1008 has notches 1010 formed at a regular interval. A uniform picture is produced when the electron beams pass through points 1036 because the electrical field of points 1036 are uniform.

EXAMPLE 2

Figure 5A:
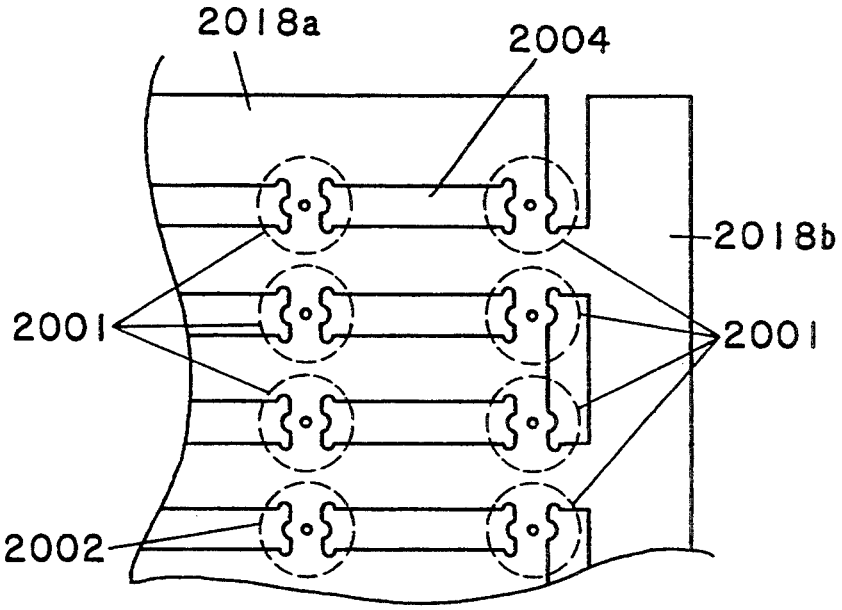
FIG. 5A and FIGS. 5*b* and 5*c* show a plane view and a partial enlarged view respectively of the vertical deflection electrode according to an exemplary embodiment of the present invention.

In this exemplary embodiment, a conductive sheet is etched to form first conductive sheet 2018*a* and second conductive sheet 2018*b* which are intermittently connected by connecting part 2001 as shown in FIG. 5A.

Figure 5B:
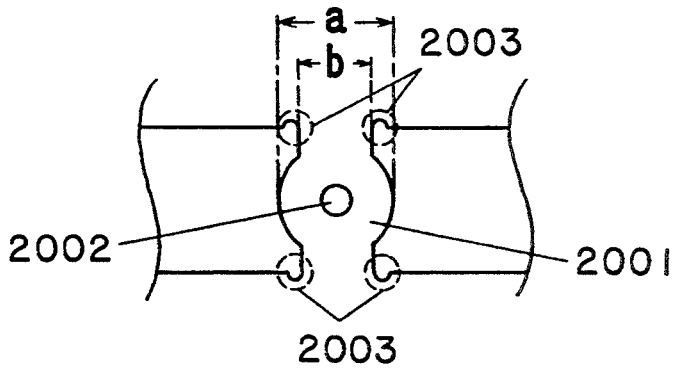
Figure 5C:
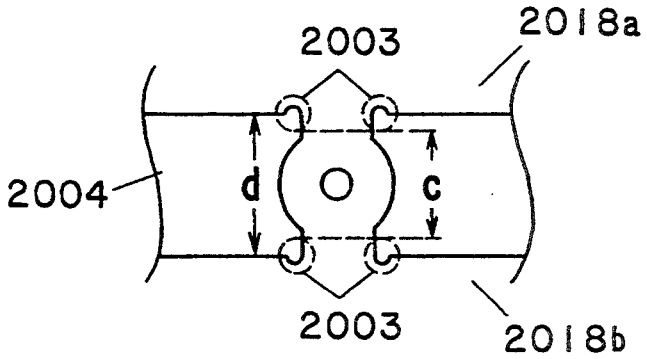

The center of connecting part 2001 is wider than both ends of connecting part 2001 as shown in the enlarged plane view of connecting part 2001 in FIGS. 5B and 5C. A hole 2002 is also formed in the center of connecting part 2001. In addition, notches 2003 are formed on each side of both ends of connecting part 2001.

Comb-shaped conductive sheets 2018*a* and 2018*b* are interdigitated along a common single plane spacing between each of the fingers of conductive sheets 2018*a* and 2018*b*. Conducting plates 2018*a* and 2018*b* form the vertical deflection electrode.

Vertical deflection electrode is joined with horizontal deflection electrode using holes 2002. Holes 2002 are used to align the horizontal deflection electrode with the vertical deflection electrode. Holes 2002 are formed on the vertical deflection electrode. When joining the vertical deflection electrode with the horizontal deflection electrode, detecting optically the paths which the electron beam pass through by using holes enables alignment between the horizontal deflection electrode and the vertical deflection electrode. In this process, the conductive sheet for the vertical deflection electrode having slits 2004 is joined with horizontal deflection electrode. Holes 2002 are also used to position connecting parts 2001 to be cut. Then, connecting parts 2001 are removed. The distance d between adjacent conductive sheets 2018*a* and 2018*b* is larger than length c of connecting part 2001. d is 1.0 to 0.01 mm. c is 0.005 mm shorter than d.

Holes 2002, notches 2003 and slits 2004 are formed by an etching process and may be formed at the same time.

Holes 2003 are also used to position the deflection electrodes accurately. The inclusion of holes 2002 does not weaken connecting part 2001 because the added width at the center of connecting part 2001 provides added strength.

Connecting part 2001 also has notches 2003 at the boundary of conductive sheets 2018*a* and 2018*b*.

The process of severing connecting parts 2001 is explained below.

As shown in FIG. 5C, connecting parts 2001 is severed along the dotted lines. The length c is smaller than the distance of slits 2004. Notches 2003 prevent conductive sheets 1029 and 1030 from being cut when severing connecting part 2001. Holes 2002 also allow the conductive sheets 2018*a* and 2018*b* to be accurately aligned so that the connecting part 2001*s* may be severed precisely. In other words, as previously described, holes 2002 are formed on the vertical deflection electrode. When joining the vertical deflection electrode with the horizontal deflection electrode, optically detecting the paths through which the electron beams pass by using the holes enables alignment between the horizontal and vertical electrodes. As a result, area of gain can be reduced.

In other words, since length c is smaller than length d, the shearing stress suffered by conductive sheets 2018*a* and 2018*b* is smaller then when length c equals length d. As a result, the area of notches 2003 can be reduced.

As explained above, holes 2002 allow the vertical deflection electrodes to be precisely aligned and the connecting parts to be accurately severed.

EXAMPLE 3

Figure 6:
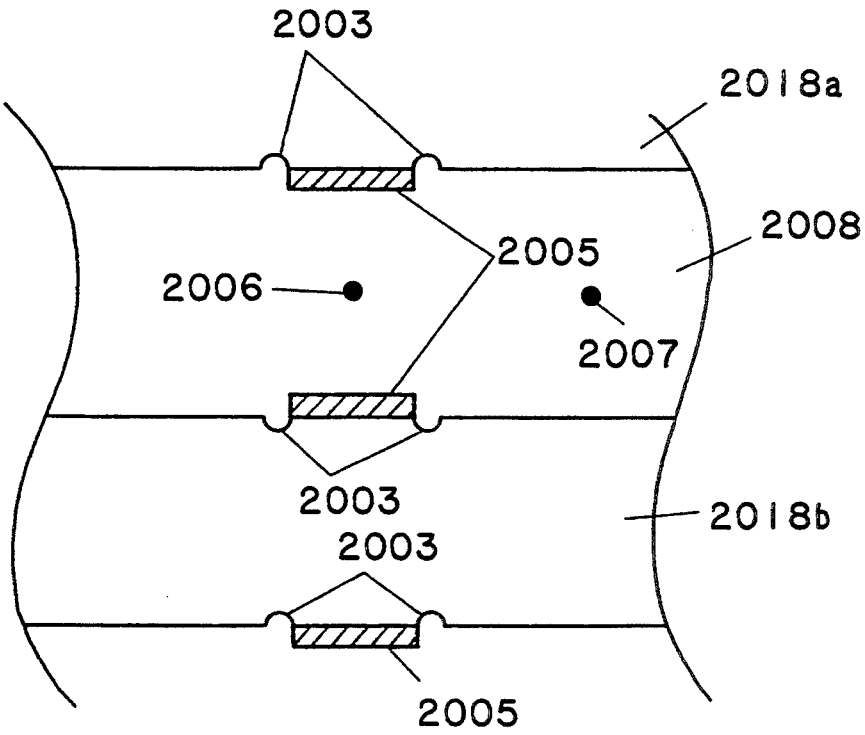
FIG. 6 shows a partial enlarged view of the vertical deflection electrode according to an exemplary embodiment of the present invention.

FIG. 6 is a partial enlarged view of vertical deflection electrode.

The first conductive sheet 2018*a* and second conductive sheet 2018*b* form the vertical deflection electrode. The distance between first conductive sheet 2018*a* and second conductive sheet 2018*b* is d. Electron beams pass through the vertical deflection electrode at points 2006 and 2007.

The vertical deflection electrode has a projecting part 2005. Projecting parts 2005 are formed opposite each other on first conductive sheet 2018*a* and second conductive sheet 2018*b* across space 2008. Projection section 2005 has notches 2003 formed on either side. The electrical field near notches 2003 differs from the electric field farther away from the notches 2003. In other words, notches 2003 cause a disturbance of the electrical field because of their concave configuration. As a result, the electron beams 2006 and 2007 are subject to different electric fields. This is because first conductive sheet 2018*a* and second conducting sheet 2018*b* have a different capacity. This causes a disturbance of the electrical field.

Projection section 2005 negate the effect of notches 2003 and as a result, the electron beams are stabilized. Convex projection section 2005 negate the disturbance of the electric field caused by concave notches 2003. Therefore, the appearance of a horizontal line caused by overlapping electron beams may be avoided.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. An image display apparatus comprising:

an electron beam generating source for generating electrons which travel in parallel with each other, a rear electrode for controlling the amount of the generated electrons, an extraction electrode for extracting electron beams from the generated electrons, a control electrode for selectively controlling the quantity of electrons in said electron beams from said extraction electrode to produce controlled electron beams, a horizontal deflection electrode for electrostatically deflecting said controlled electron beams to produce horizontal deflected electron beams, a vertical deflection electrode for deflecting said horizontal deflected electron beams to produce deflected electron beams, said vertical deflection electrode having a first comb-shaped conductive sheet having a plurality of first parallel members and a second comb-shaped conductive sheet having a plurality of second parallel members where said plurality of first parallel members and said plurality of second parallel members are alternately formed adjacent to each other in a horizontal direction, said first comb-shaped conductive sheet and said second comb-shaped conductive sheet having a plurality of notches formed at regular intervals and said horizontal deflection electrode are insulated from each other, and display means for receiving and displaying light corresponding to said deflected electron beams.

2. The image display apparatus of claim 1 wherein said electron beam generating source is a plurality of linear cathodes.

3. The image display apparatus of claim 1 wherein said horizontal deflection electrode and said vertical deflection electrode are insulated from each other by a low melting point solder glass.

4. An image display apparatus comprising:

an electron beam generating source for generating electrons which travel in a parallel direction, a rear electrode for controlling the amount of the generated electrons, an extraction electrode for extracting electron beams from the generated electrons, a control electrode for selectively controlling the amount of electrons in said electron beams to produce controlled electron beams, a focusing electrode for electrostatically focusing said controlled electron beams to produce focused electron beams, a horizontal deflection electrode for electrostatically deflecting said focused electron beams to produce horizontally deflected electron beams, a vertical deflection electrode for deflecting said horizontal deflected electron beams to produce deflected electron beams, said vertical deflection electrode having a first comb-shaped conductive sheet and a second comb-shaped conductive sheet, each conductive sheet having a plurality of first and second parallel members respectively, said first and second comb-shaped conductive sheets insulated from each other and said first and second members alternatively formed adjacent to each other where said plurality of first parallel members and second parallel members are alternatively disposed in a horizontal direction, said first conductive sheet and said second conductive sheet further including a plurality of projection sections disposed between notches, said horizontal deflection electrode and said vertical deflection electrode insulated from each other and display means for receiving said deflected electron beams and for displaying light corresponding to said deflected electron beams.

5. The image display apparatus of claim 4 wherein said horizontal deflection electrode and said vertical deflection electrode are insulated from each other by a low melting point solder glass.

6. The image display apparatus of claim 4 wherein said electron beam generating source is a plurality of linear cathodes.

* * * * *